US006905360B2

(12) United States Patent
Berger et al.

(10) Patent No.: US 6,905,360 B2
(45) Date of Patent: Jun. 14, 2005

(54) POWER CORD CONNECTOR FOR AN APPLIANCE

(75) Inventors: Thomas R Berger, Racine, WI (US); Jerry G Ryder, Lake Bluff, IL (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/604,084

(22) Filed: Jun. 25, 2003

(65) Prior Publication Data

US 2004/0053523 A1 Mar. 18, 2004

Related U.S. Application Data

(60) Provisional application No. 60/391,715, filed on Jun. 26, 2002.

(51) Int. Cl.[7] ..... H01R 4/24

(52) U.S. Cl. ..... 439/441; 439/939

(58) Field of Search ..... 174/50.56, 50.6; 439/106, 441 I, 471, 546, 547, 548, 939

(56) References Cited

U.S. PATENT DOCUMENTS 4,579,405 A * 4/1986 Hirooka ..... 439/106
5,292,260 A * 3/1994 Sinisi et al. ..... 439/441
5,759,064 A * 6/1998 Sugiyama ..... 439/548
5,911,595 A * 6/1999 Orr et al. ..... 439/471
6,540,385 B2 * 4/2003 Ikeda et al. ..... 362/512
6,679,726 B1 * 1/2004 Tunn et al. ..... 439/565

* cited by examiner

*Primary Examiner*—Thanh-Tam Le
(74) *Attorney, Agent, or Firm*—Locke Liddell & Sapp LLP

(57) ABSTRACT

A quick connect plug for electrically connecting and mechanically attaching a power cord to an appliance, such as a disposer, is disclosed. The plug is connected to an end of the power cord. In one embodiment, the plug houses push-in terminals, which are electrically connected to first and second wires of the power cord. A first portion of the plug defines openings to receive leads from the disposer, which electrically connect to the push-in terminals housed in the plug. The first portion positions through an aperture defined in a metal portion or lower end frame of the disposer. A plurality of tabs disposed about the first portion engage an inside surface of the lower end frame of the disposer. A second portion of the plug is connected to the cord and defines a shoulder with the first portion. A conductive ring is disposed on the shoulder and is electrically connected to the ground wire of the power cord. The conductive ring contacts the metal frame of the disposer.

48 Claims, 11 Drawing Sheets

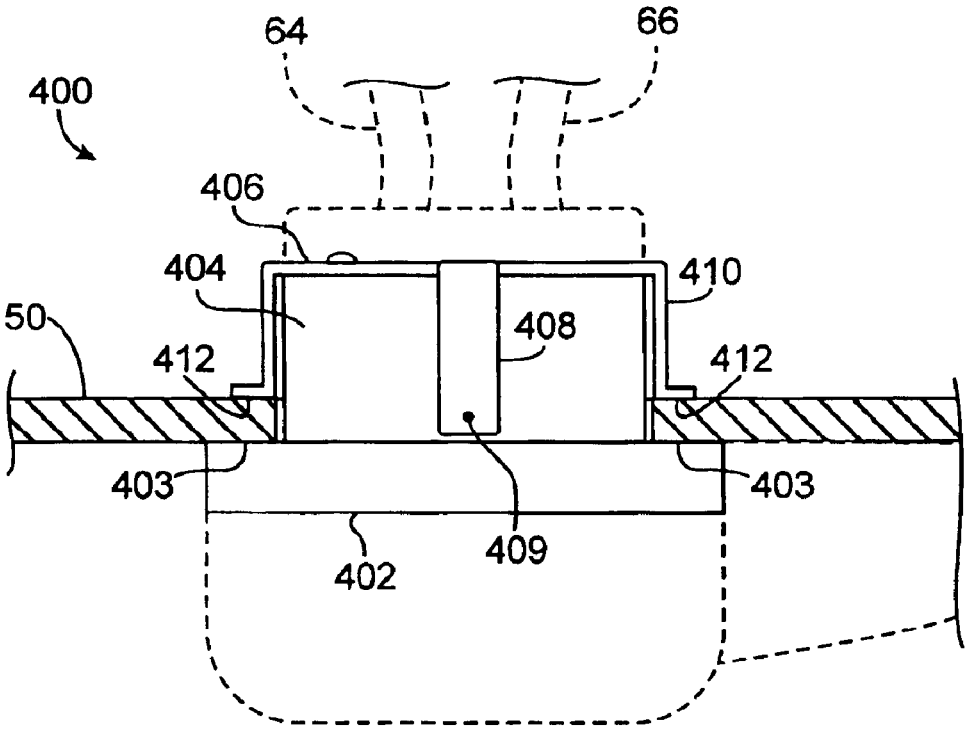
FIG. 8E
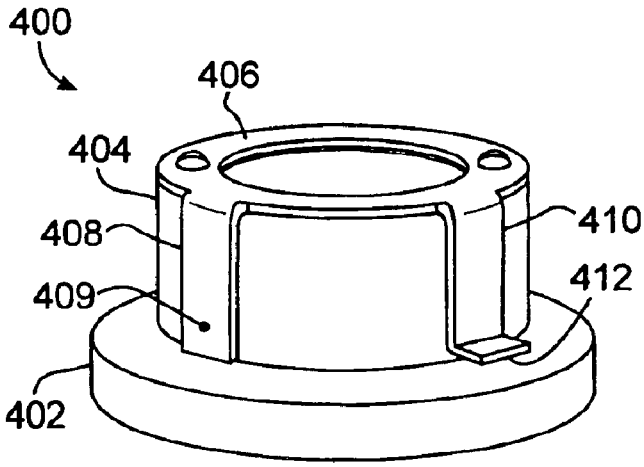

POWER CORD CONNECTOR FOR AN APPLIANCE

CROSS REFERENCE TO RELATED APPLICATIONS

This application claims the benefit of U.S. Provisional Patent Application Ser. No. 60/391,715 filed on Jun. 26, 2002, which is hereby incorporated by reference in its entirety.

BACKGROUND OF INVENTION

The present invention relates generally to a cord for supplying power to an appliance, such as a food waste disposer.

Operation of an appliance requires proper connection of a power cord to the appliance. Appliances typically include components requiring a particular connection to a power source, such as a specific phase arrangement for AC power or a specific positive and negative connection for DC power. Furthermore, connection of the power cord to the appliance must be mechanically secure to prevent possible disconnection of the cord and to prevent damage to the cord where it interfaces with the appliance.

Conventional practice in connecting a power cord to an appliance can involve tedious or time-consuming assembly, which can lead to slow manufacturing of the appliance or possible errors in the connection of the power cord. Difficulties in connecting the power cord to the appliance can also hinder the possibility of automating the assembly. These and other considerations concerning power cords for appliances are well known in the art.

A food waste disposer is one appliance having a power cord. Referring to FIG. 1, a typical connection of a power cord to a food waste disposer is schematically illustrated. On one end, the power cord 10 has an outlet plug 12 for connection to a conventional power supply, such as a wall socket. A "hot" wire 14, a "neutral" wire 16, and a ground wire 18 are insulated together in the cord 10. A bushing 20, shown in relevant detail in FIG. 2, is on the cord 10. The disposer has a lower end frame 30, which is a metal portion for supporting additional components (not shown) of the disposer. The lower end frame 30 defines a hole 32. The bushing 20 is installed in the hole 32 with the cord 10 passing therethrough. The bushing 20 rigidly holds and protects the cord 10 where it interfaces with the lower end frame 30. The bushing 20 can be pressed against the sides of the hole 32 and can include a rim or shoulder 21 to hold the bushing 20 in the hole 32.

Referring briefly to FIG. 2, the bushing 20 is illustrated in cross-section with further details shown. The bushing 20 includes two portions 22 and 26 connected together by a flexible member 27. The cord (not shown) is positioned in a passage 24 of the larger portion 22 and passes from one end 23 to another end 25. The smaller portion 26 includes an extension 28 and fits between sides (not shown) of the larger portion 22. The extension 28 produces a crimp in the cord to hold it firmly in the bushing 20.

Returning to FIG. 1, the three wires 14, 16, and 18 of the power cord 10 pass through the bushing 20 and inside the disposer. The "hot" and "neutral" wires 14 and 16 are connected to leads 44 and 46 of an electrical system 40 of the disposer. The electrical system 40 typically includes a switch assembly (not shown), an overload switch (not shown), and an induction motor (not shown), among other components known in the art. In particular, the "hot" wire 14 is connected to a first lead 44 with a first wire nut or crimp connector 15. The "neutral" wire 16 is connected to a second lead 46 with a second wire nut or crimp connector 17. The ground wire 18 of the cord 10 has a ring terminal 19. Although not shown here, the ring terminal 19 is typically used to connect the ground wire 18 to the lower end frame 30 with a screw (not shown).

Unfortunately, electrically connecting and mechanically attaching the conventional power cord 10 to the disposer involves tedious or time-consuming assembly. Referring to FIG. 3, assembly of the prior art connection will now be discussed. In FIG. 3, a bottom view of a portion of the lower end frame 30 of the disposer is illustrated. The lower end frame 30 defines the hole 32 for the bushing 20 and cord 10. The lower end frame 30 also defines an opening 34 for accessing the cord wires and disposer leads within the disposer. The lower end frame 30 has a shield 36 for protecting the wires and leads from moving components in the disposer and has a cover 38 (shown partially cutaway) for covering the wire access opening 34 after assembly.

During assembly, the bushing 20 is positioned on the power cord 10 as described above. Unconnected ends of the cord wires 14, 16, and 18 are disposed through the hole 32 in the lower end frame 30. These unconnected ends are stripped to expose conductive ends of the cord wires 14 and 16. The bushing 20 on the cord 10 is then installed into the hole 32. The bushing 20 is forced into the hole 32 by simultaneously pressing the bushing 20 into the hole 32 and crimping the cord 10 in the bushing 20. A tool may be required to install the bushing 20 and cord 10 in the hole 32. The sides and rim of the bushing 20 press against the edge of the hole 32 with a compression fit to hold the bushing 20 and cord 10 to the lower end frame 30.

With the cover plate 38 removed, the stripped ends of the cord wires 14 and 16 and the stripped ends of the disposer leads 44 and 46 are accessed by hand through the wire access opening 34. Assembly personnel connect the "hot" wire 14 and disposer lead 44 together with the wire nut or crimp connector 15 and connect the "neutral" wire 16 and lead 46 together with the wire nut or crimp connector 17. The ring connector 19 crimped on the ground wire 18 is connected to the wire shield 36 on the lower end frame 30 with a screw 37.

The prior art method of connecting and attaching the power cord 10 to the disposer is prone to potential errors. The connection of the electrical system 40 of the disposer to the power supply requires correct connection of the cord wires 14, 16 to the disposer leads 44 and 46 and the ground wire 18 to the lower end frame 30. Typically, the wires and leads are simply color-coded to facilitate their proper connection. Except for such color-coding, there is no guidance or built-in system for determining or indicating which cord wires connect to which disposer leads. Consequently, the possibility of incorrectly connecting the wires and leads is increased.

In addition, the prior art method of connecting the cord 10 to the disposer requires special tools for installation and requires a number of steps to be performed. The tools required include, for example, a crimping tool for crimping the connectors 15 and 17 on the disposer leads 44, 46 and cord wires 14, 16. To make the electrical connection, assembly personnel or field installers must make the various connections one at a time and by hand. Such difficult and time-consuming operations complicate the assembly and installation of the disposer.

Although the electrical connection described above is effective, manufacturers strive to provide quicker and easier ways to connect power cords to appliances, such as food waste disposers. It is desirable to have a power cord connection that can be easily performed without requiring special tools, a number of steps, or considerable effort. In addition, it is desirable to have a power cord connection that grounds a frame of the appliance without a traditional fastener, such as ring terminal 19 and screw 37. The present invention is directed to overcoming, or at least reducing the effects of, one or more of the problems set forth above.

SUMMARY OF INVENTION

A quick connect plug for electrically connecting and mechanically attaching a power cord to an appliance, such as a disposer, is disclosed. The plug is connected to an end of the power cord. In one embodiment, the plug houses push-in terminals, which are electrically connected to first and second wires of the power cord. A first portion of the plug defines openings to receive leads from the disposer, which electrically connect to the push-in terminals housed in the plug. The portion positions through an aperture defined in a metal portion or lower end frame of the disposer. A plurality of tabs disposed about the first portion engage an inside surface of the lower end frame of the disposer. A second portion of the plug is connected to the cord and defines a shoulder with the first portion. A conductive ring is disposed on the shoulder and is electrically connected to the ground wire of the power cord. The conductive ring contacts the metal frame of the disposer.

The foregoing summary is not intended to summarize each potential embodiment or every aspect of the invention disclosed herein.

BRIEF DESCRIPTION OF DRAWINGS

The foregoing summary, a preferred embodiment, and other aspects of the present invention will be best understood with reference to a detailed description of specific embodiments of the invention, which follows, when read in conjunction with the accompanying drawings, in which:

FIGS. 8A–E illustrate various embodiments of conductive members for a quick connect plug according to the present invention.

Figure 1:
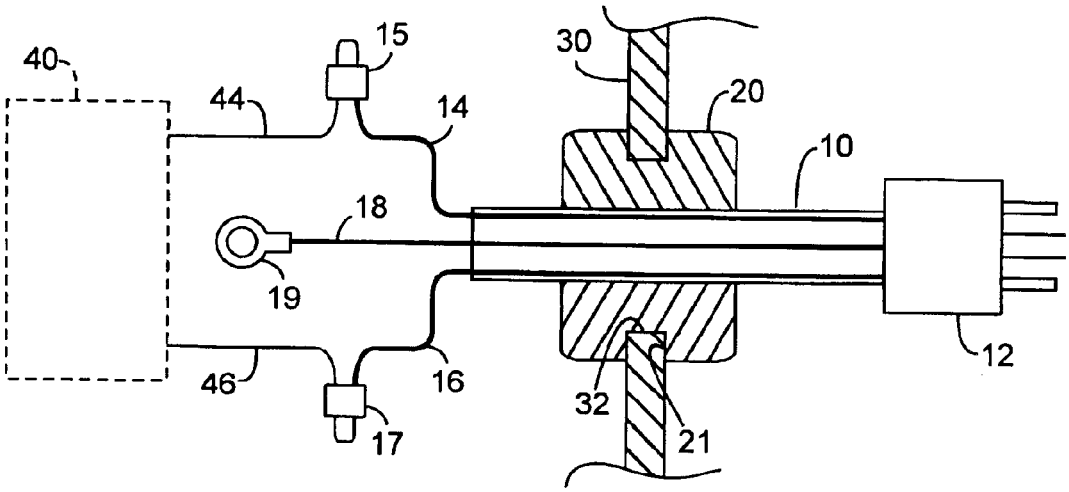
FIG. 1 (Prior Art)
FIG. 1 schematically illustrates a connection of a power cord to a waste disposer according to the prior art.
Figure 2:
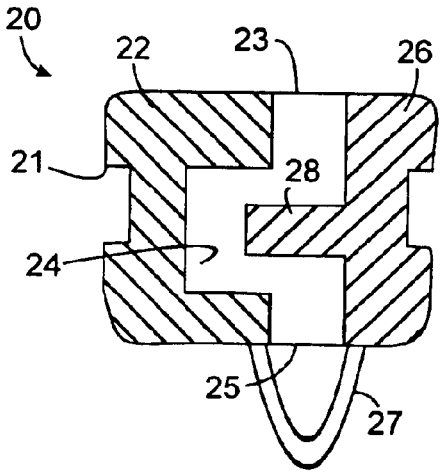
FIG. 2 (Prior Art)
FIG. 2 illustrates a bushing according to the prior art for connecting the power cord to a lower end frame of the disposer.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the scope of the invention as defined by the appended claims.

DETAILED DESCRIPTION

In the interest of clarity, it is understood that not all features of actual implementations of a quick connect plug are described in the disclosure that follows. In an effort to develop an actual implementation, as in any project, numerous engineering and design decisions must be made to achieve the specific goals of the developer (e.g., compliance with mechanical-related and business-related constraints). The specific goals and constraints may vary from one implementation to another. Moreover, in the effort to develop an actual implementation of a quick connect plug, attention must necessarily be paid to proper engineering and design practices for the environment in question. Such development efforts would be a routine undertaking for those of skill in the art having the benefit of the present disclosure.

Figure 4:
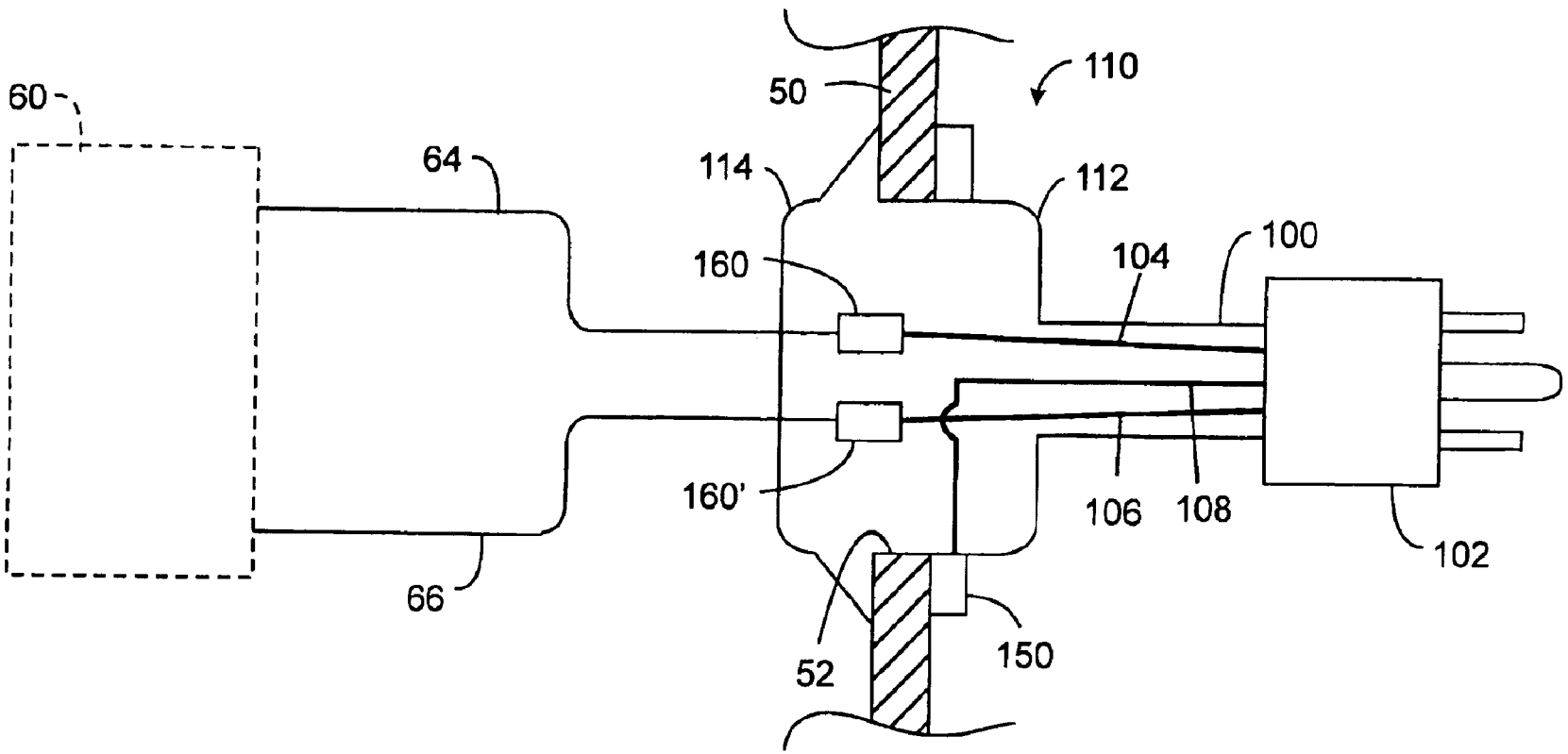
FIG. 4 schematically illustrates a connection of a power cord to a waste disposer according to the present invention.

Referring to FIG. 4, a power cord connection according to the present invention for an appliance is schematically illustrated. The example appliance in the disclosure that follows is a food waste disposer having a metal portion or lower end frame 50. It will be appreciated by one skilled in the art, however, that the power cord connection of the present invention is applicable to a number of appliances other than food waste disposers.

The connection includes a power cord 100 having a first or "hot" wire 104, a second or "neutral" wire 106, and a ground wire 108, which are insulated together: On one end, the power cord 100 may have an outlet plug 102 for connecting to a conventional AC power supply and ground. For example, the outlet plug 102 may be a standard National Electronics Manufacturing Association (NEMA) 5-15P grounding plug. Although the present embodiment is directed to a single or a two phase power arrangement having two power wires and a ground, it is understood that the present invention can work equally as well with other power arrangements, such as a three phase arrangement having three power wires and a ground, for example.

The connection also includes a quick connect plug 110 on another end of the power cord 100. The quick connect plug 110 mechanically attaches the cord 100 to the lower end frame 50 of the disposer and electrically connects the cord 100 to an electrical system 60 of the disposer. Furthermore, the quick connect plug 110 grounds the lower end frame 50 of the disposer.

The plug 110 includes a first end or portion 112 and a second end or portion 114. The first end 112 is connected to the cord 100. Ends of the wires 104, 106, and 108 of the cord 100 pass into the plug 110. Connective members 160 and 160' are housed in the plug and are electrically connected to ends of the wires 104 and 106. A connective member 150 is disposed on the outside of the plug 110 and is electrically connected to the ground wire 108 of the cord 100.

To electrically connect the plug 110 to the disposer, leads 64 and 66 from the electrical system 60 are received in the second end 114 and are electrically connected to the connective members 160 and 160'. As is known in the art, the leads 64 and 66 from the electrical system 60 of the disposer connect to a start switch (not shown) and an overload switch (not shown), which control power to windings of a motor (not shown) in the disposer. For a disposer, the leads 64 and 66 are typically stranded or tinned 18-gauge, insulated wire.

To mechanically attach the plug 110 to the disposer, the second end 114 is positioned in a hole 52 defined in the lower end frame 50. To hold the plug 110 to the frame 50, the first end 112 engages an outside surface of the frame 50 adjacent the hole 52, and the second end 114 engages an inside of the frame 50 adjacent the hole 52. To ground the lower end frame 50, the conductive member 150 that is electrically connected to the ground wire 108 contacts the outside surface of the frame 50 adjacent the hole 52.

Figure 5B:
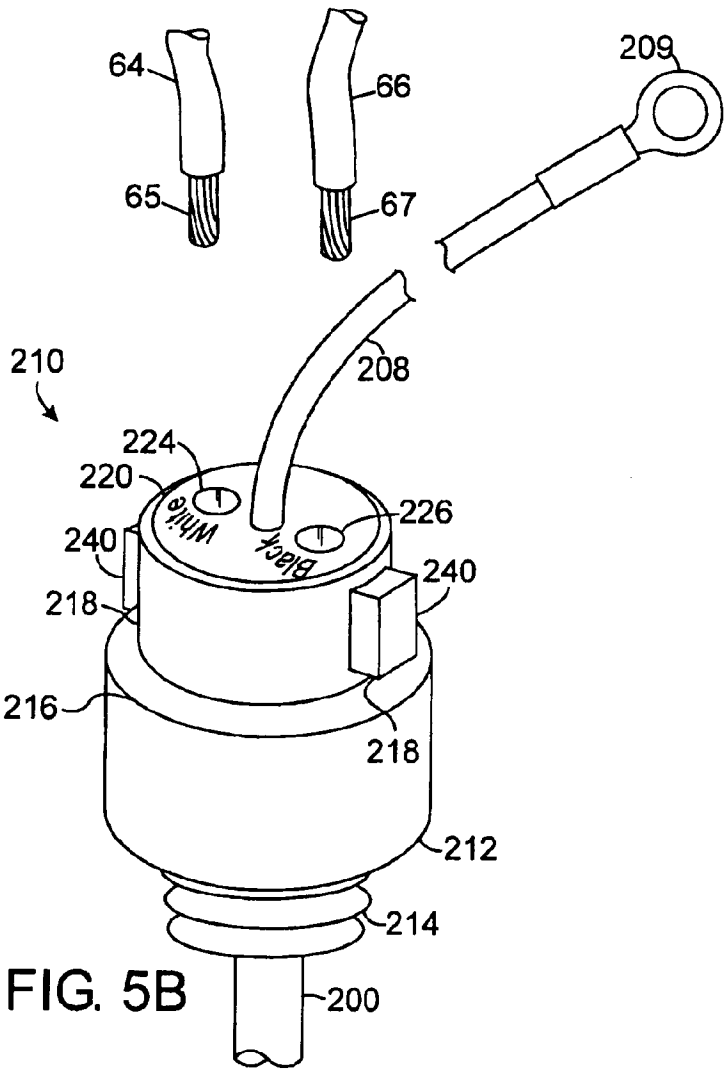
FIG. 5B illustrates a perspective view of an alternate embodiment of quick connect plug on a power cord according to the present invention.
Figure 5A:
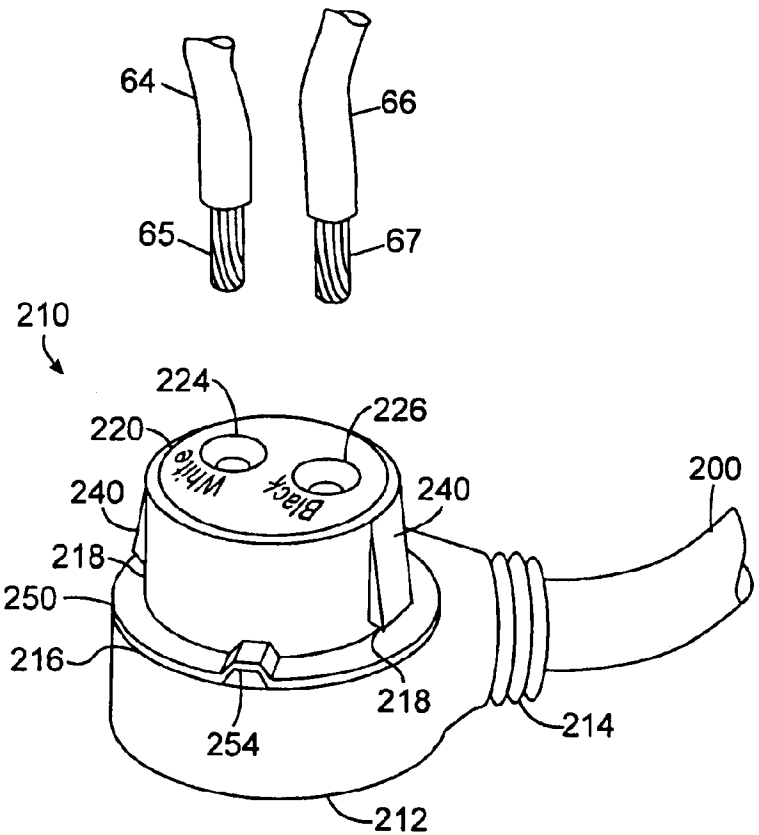
FIG. 5A illustrates a perspective view of an embodiment of a quick connect plug on a power cord according to the present invention.

Referring to FIG. 5A, an embodiment of a quick connect plug 210 is illustrated in a perspective view on a power cord 200. The quick connect plug 210 and cord 200 can be molded together out of polyvinyl chloride or other suitable materials known in the art. The plug 210 includes a first portion 212, a second portion 220, one or more retainers 240, and a conductive member 250. The first portion 212 is connected to the power cord 200. Flexure members 214 are preferably formed at the juncture of the first portion 212 and the cord 200 to prevent damage due to bending or twisting.

The second portion 220 extends from the first portion 212 and has the one or more retainers 240 disposed thereon. The second portion 220 has a smaller dimension than the first portion 212 so that a shoulder 216 is defined therebetween. Although shoulder 216 is depicted in the figures as completely encircling the perimeter of second portion 220, it is however envisioned that one or more individual shoulders or stops can also be used to reap the advantages of the present disclosure as described herein. The conductive member 250 is disposed at the shoulder 216 and is electrically connected to the ground wire (not shown) of the cord 200.

In the present embodiment, the one or more retainers 240 are tabs disposed about a periphery of the second portion 220. The tabs 240 are angled from their leading ends at the face of the second portion 220 to facilitate insertion in the hole of the lower end frame as described below. The tabs 240 define gaps 218 with the shoulder 216 and conductive member 250 to accommodate the width of the lower end frame when the plug 210 is installed as described below.

In the present embodiment, the conductive member 250 is preferably a ring fully encompassing the perimeter of the shoulder 216. The conductive member 250, however, can include other shapes or less encompassing forms. In addition, the conductive member 250 need not necessarily be positioned at a shoulder of the plug 210 as in the present embodiment. The conductive member 250 can include one or more detents 254 for locking the plug, as best described below.

The second portion 220 defines lead openings 224 and 226 in its face for receiving the leads 64 and 66 of the disposer. In FIG. 5A, the disposer leads 64 and 66 are shown ready for insertion into the lead openings 224 and 226. Once inserted, the disposer leads 64 and 66 connect to connective members (not shown), which are housed within plug 210.

Figure 3:
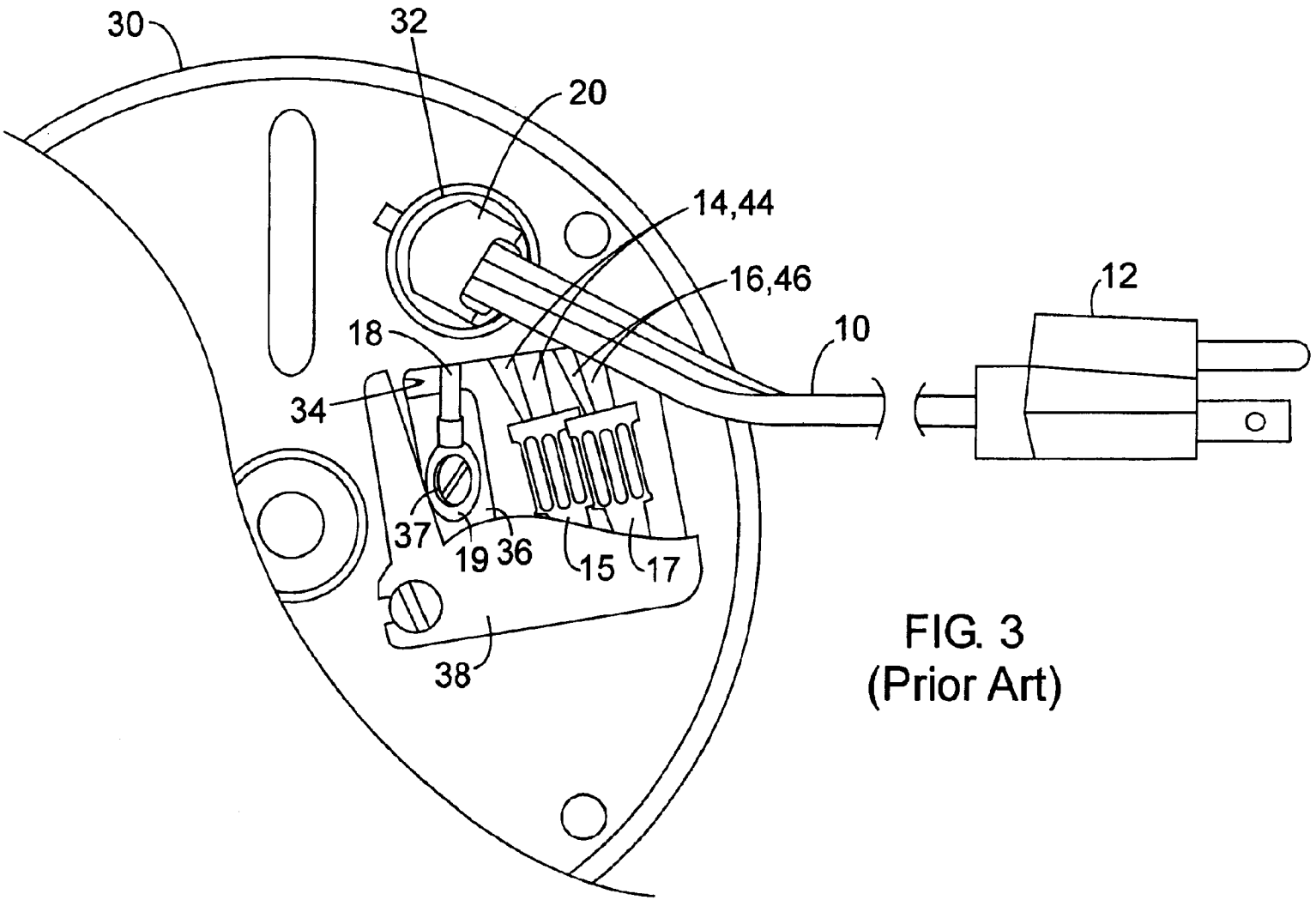
FIG. 3 (Prior Art)
FIG. 3 illustrates a bottom view of a portion of the lower end frame having the power cord connection according to the prior art.

FIG. 5B depicts an alternate embodiment of the present invention in which quick connect plug 210 is shown having a first portion 212, a second portion 220, and one or more retainers 240 as in FIG. 5A. Instead of the conductive member 250 shown in FIG. 5A, ground wire 208 is provided having a ring terminal 209. Although not shown here, the ring terminal 209 is used to connect ground wire 208 to the lower end frame of the food waste disposal as described previously with respect to ground wire 18 and ring terminal 19 in FIG. 3. This method and apparatus for grounding the disposer utilizes a quick connection with respect to the disposer leads, but provides an alternate scheme for grounding the disposer. Aside from this alternate grounding scheme, this embodiment otherwise functions and engages with the disposer as described with respect to the preferred embodiment described in FIG. 5A.

Figure 6A:
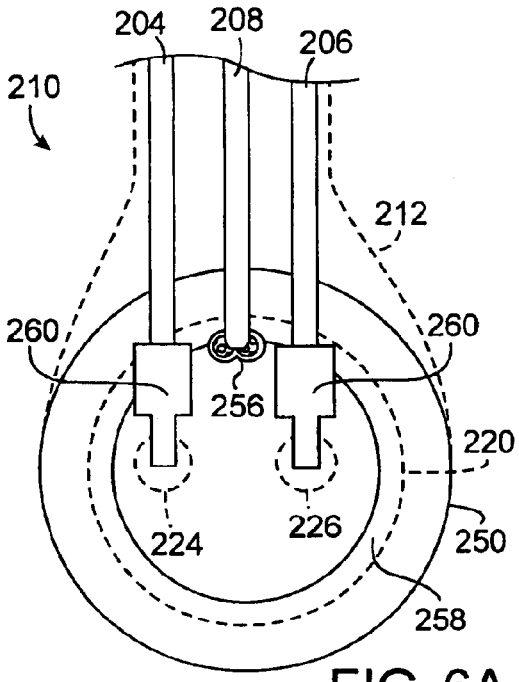
FIG. 6A illustrates a bottom, plan view of the quick connect plug of FIG. 5 according to the present invention.

Referring to FIG. 6A, an internal view of the quick connect plug 210 of FIG. 5A is shown. In FIG. 6A, the first portion 212 and the second portion 220 of the plug 210 are illustrated in broken lines so that internal arrangements of components of the plug 210 can be seen. A first, second, and ground wire 204, 206, and 208 are shown housed in the cord 200. The first and second wires 204 and 206 are each connected to a connective member 260 adjacent the wire openings 224 and 226 of the plug 210. As best shown below in FIG. 6C, the connective members 260 and the conductive member 250 are separated and insulated from one another by the material of the plug 210.

The conductive member 250 includes an attachment portion 256, which connects onto the ground wire 208 of the cord. As with the connective member 260, the attachment portion 256 of the conductive member 250 is housed within the material of the plug 210 when formed. The conductive member 250 is a ring defining an outer diameter approximately equal to the diameter of the first portion 212 of the plug. The conductive member 250 also defines an inner diameter that is preferably less than the diameter of the second portion 220 of the plug 210. Thus, internal portions 258 of the conductive member 250 can be molded between the juncture of the first and second portions 212 and 220.

Figure 6B:
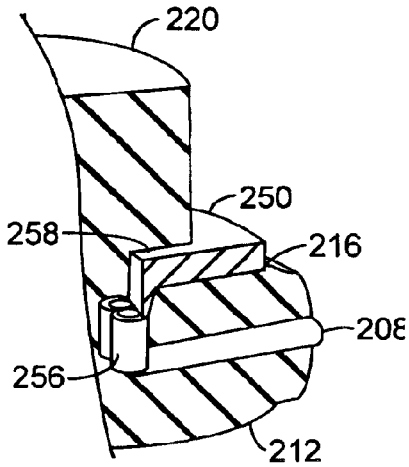
FIG. 6B illustrates a partial, cross-sectional view of the quick connect plug having the ground wire of the cord connected to the conductive member according to the present invention.

Referring to FIG. 6B, a partial cross-section of the plug 210 is shown having the conductive member 250 connected to the ground wire 208 of the power cord. The conductive member 250 includes the attachment portion 256, which in the present embodiment is crimped on the ground wire 208 of the cord and molded in the material of the plug 210. It will be appreciated by one of ordinary skill in the art, however, that the electrical connection of the conductive member 250 to the ground wire 208 can be performed by a number of techniques known in the art. The internal portion 258 of the conductive member 250 is shown to slightly extend under the second portion 220 to illustrate its molding in the material. By having portions 258 of the conductive member 250 extending and molded into the material of the plug 210, the conductive member 250 is held to the plug 210. Instead of being a uniform, planar ring as shown, the internal portion 258 of the conductive member 250 can include rib portions (not shown) extending perpendicularly. Such ribs may be used to further hold the conductive member 250 molded in the material of the plug 210.

Figure 6C:
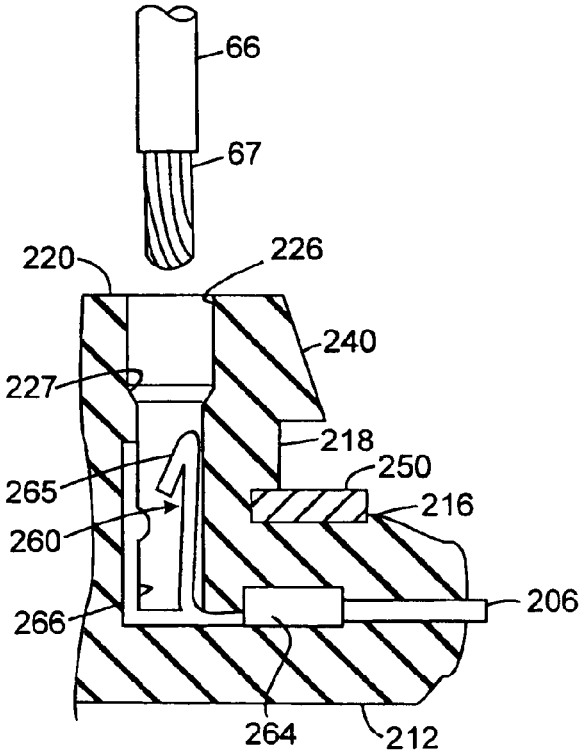
FIG. 6C illustrates a partial, cross-sectional view of the quick connect plug housing a push-in terminal according to the present invention.
Figure 6D:
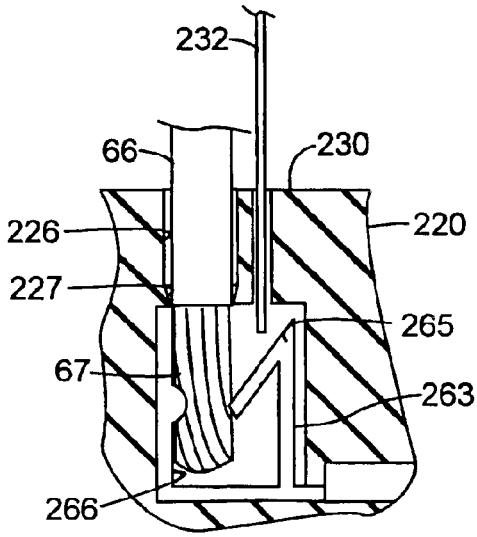
FIG. 6D illustrates a partial, cross-sectional view of the quick connect plug and push-in terminal having a mechanism for releasing the disposer lead according to the present invention.

Referring to FIG. 6C, a partial cross-section of the plug 210 is shown housing one embodiment of a connective member 260. Preferably, the connective member 260 housed in the plug 210 is a push-in terminal capturing a conductive, stripped end 67 of the disposer lead 66 by catching a hooked or kinked end 265 of the push-in terminal 260 on the stripped end 67. Connective member 260 preferably traps the stripped end 67 against yet another metallic surface 266 which helps to ensure proper electrical contact with the lead. In addition to push-in terminals, is understood that other connective members, terminals, or connectors known in the art may be housed in the plug 210 to connect to the disposer leads. Although only one push-in terminal 260 is shown, the other push-in terminal, as shown in FIG. 6D, may be substantially similar.

The second portion 220 of the plug 210 defines the lead opening 226, which includes a shoulder 227 to stop insertion of the disposer lead 66 by engaging the insulation of the lead. The push-in terminal 260 also includes an attachment portion 264 electrically connected to a wire 206 of the cord (not shown). By receiving the conductive end 67 of the lead 66, the push-in terminal 260 eliminates the need for the tedious wire or crimp connections of the prior art. Furthermore, the plug 210 can be readily used with new or existing disposers in the field, because the lead does not require a specific connector or terminal to be crimped on the end.

The lead 66 can also be released from the end 67 from the terminal 260. In one embodiment shown in FIG. 6D, the plug 210 and push-in terminal 260 include a mechanism for releasing the end 67 of the lead 66 from the terminal portion 262. A small opening 230 is provided in the face of the second portion 220 adjacent the lead opening 226. By inserting a thin tool or instrument 232, such as a pin, in the small opening 230, the terminal 260 can be moved so that it no longer captures the end 67. In this regard, the terminal 260 can include a shelf or catch 263. The distal end of the tool 232 can contact the catch 263 to move or bend the terminal 260. Once the terminal 260 is moved away from the end 67, the lead 66 can be removed from the plug 210. The terminal 260 can then be released to recapture an end of another lead. By enabling the lead to be released with such a release mechanism, the plug 210 and power cord 200 can be reused.

Figures 7A, 7B:
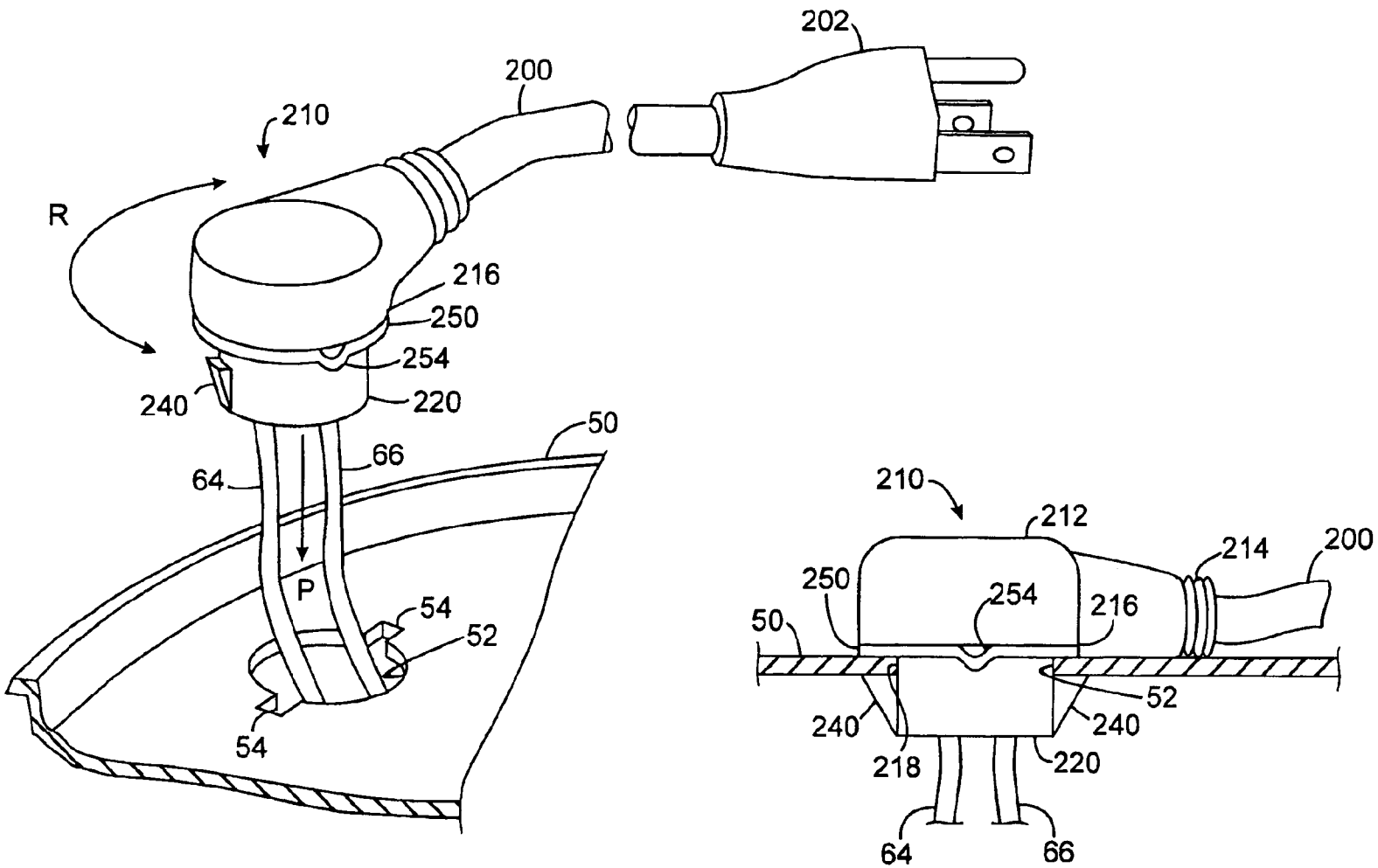
FIG. 7A illustrates the quick connect plug of FIG. 5 in a stage of connecting to the disposer.
FIG. 7B illustrates a side view of the quick connect plug connected on the lower end frame.

Referring to FIGS. 7A and 7B, connection of the quick connect plug 210 of FIG. 5 to the disposer will be discussed. In FIG. 7A, the quick connect plug 210 is shown in a stage of connecting to the disposer. In FIG. 7B, the quick connect plug 210 is illustrated in a side view connected on the lower end frame 50, which is shown in cross-section to reveal relevant details.

With the disposer leads 64 and 66 connected to the connective members (not shown) housed in the plug 210 as described earlier, assembly personnel or a field installer inserts the second portion 220 of the plug 210 in the hole 52 defined in the lower end frame 50. The hole 52 includes one or more slots 54. The second portion 220 is inserted into the hole 52 in direction P with the retainers 240 aligned with the slots 54. The conductive member 250 and the shoulder 216 of the plug 210 engage the outside surface of the lower end frame 50 adjacent the hole 52. The plug 210 is then turned approximately 90-degrees in direction R. The conductive member 250 preferably has one or more detents 254. When the plug 210 is turned in the hole 52, the detents 254 dispose in the slots 54 to prevent accidental turning of the plug 210 in the hole 52 and to ground the conductive member 250 (and hence ground wire 208) to the lower end frame 50. Accordingly, the quick connect plug 210 substantially reduces the amount of labor to connect the power cord 100 to the disposer and eliminates the need for tools to complete the installation.

As best shown in FIG. 7B, the edge of the hole 52 fits in the gaps 218 between the retainers 240 and the conductive member 250 on the shoulder 216. The plug 210 is held in the hole 52 by the retainers 240 engaging the inside surface of the lower end frame 50 and by the conductive member 250 and shoulder 216 engaging the outside surface. The conductive member 250 is preferably composed of a suitable material to establish electrical continuity with the lower end frame 50, which is typically formed from a stamped or cast metal.

The cord 200 need not necessarily connect at a 90-degree angle to the first portion 212 as illustrated, but can connect at other angles depending on the particular implementation or the intended appliance. The 90-degree bend of the cord 200 from the first portion 212 facilitates packaging of the disposer when the cord 200 and plug 210 are pre-assembled on the disposer. If the cord 200 were to be pulled, however, the 90-degree bend may enable the plug 210 to be more readily removed from the hole 52. Appropriate dimensions and design of the plug 210 to withstand being pried from the hole 52 can be easily determined by those of ordinary skill in the art. Having the cord 200 extend straight from the first portion 212 may also enable the mechanical attachment of the plug 210 to withstand a predetermined force and may help prevent the plug 210 from being pried from the hole 52.

The quick connect plug 210 is preferably composed of one or more materials, such as thermoplastic, polyvinyl chloride, or nylon. The material is preferably suitable for insulating and protecting the electrical components housed in the plug 210. In addition, the material for at least some of the plug 210, such as the second end 220 and retainers 240, is preferably hard enough not to be unduly damaged or cut when the plug 210 is inserted and turned in the hole 52. Furthermore, because the plug 210 is molded around the conductive member 250, the material adjacent the conductive member 250 preferably has appropriate properties of rigidity and thermal resistance to maintain the conductive member 250 in continuity with the lower end frame 50.

The plug 210 can be formed by molding a single material, such as a hard thermoplastic or nylon. If insulated with a softer material, the cord 200 can connect to the plug 210 using a clamp or other mechanism known in the art. Alternatively, the plug 210 can be formed by molding combination of materials to house the components. In addition, the plug 210 can be formed by a combination of pre-molds and over-molds of one or more materials. For example, the plug 210 can be formed by a pre-mold of a hard nylon having an over-mold of PVC.

It is understood by one of ordinary skill in the art that properties, materials, components, and other aspects of the plug 210 must necessarily meet a number of industry standards and tests known in the art. In general, industry standards and tests address secureness, mold stress relief, overloading, resistance to arcing, ground continuity, pullout force, heating, insulation resistance, flammability, etc. For example, the Underwriters Laboratories (UL) codes UL 498 for "Attachment Plugs and Receptacles" or UL 817 for "Cord Sets and Power-Supply Cords" may suggest requirements pertinent to the present disclosure. One skilled in the art would find it a routine undertaking to conform aspects of the present invention to such industry standards and tests.

Referring to FIGS. 8A–E, various embodiments of conductive members for the quick connect plug of FIGS. 5A and 7A–B are illustrated. For simplicity, outer sides of a first portion 212, a shoulder. 216, and a second portion 220 of a quick connect plug are shown with dashed lines in the side views of FIGS. 8A–E. For simplicity, portions for attaching a ground wire (not shown) to the conductive members 270, 280, 290, 296, and 400 are not shown in FIGS. 8A–E.

Figure 8A:
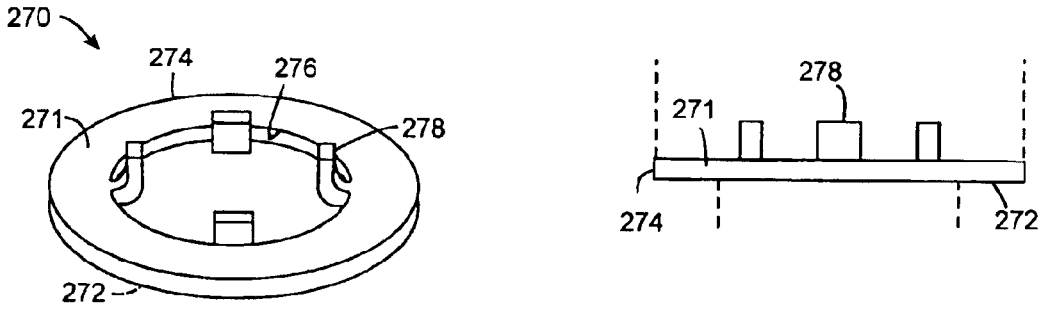

In FIG. 8A, an embodiment of a conductive member 270 is illustrated in a perspective view and a side view. The conductive member 270 includes a ring shaped body 271 having an outer diameter 274 and an inner diameter 276. As best shown in the side view of FIG. 8A, the conductive member 270 is molded onto the quick connect plug at the shoulder 216 so that one side 272 of the body 271 can contact a lower end frame (not shown). To improve the secureness of the conductive member 270 on the plug, a plurality of extensions 278 extend from the inner diameter 274 of the ring shaped body 271. The extensions 278 secure the conductive member 270 to the plug when molded thereon. In the present embodiment, all of the extensions 278 extend in a direction away from the side 272 for contacting the lower end frame are molded into the first portion 212 of the plug, but this is not strictly necessarily.

Figure 8B:
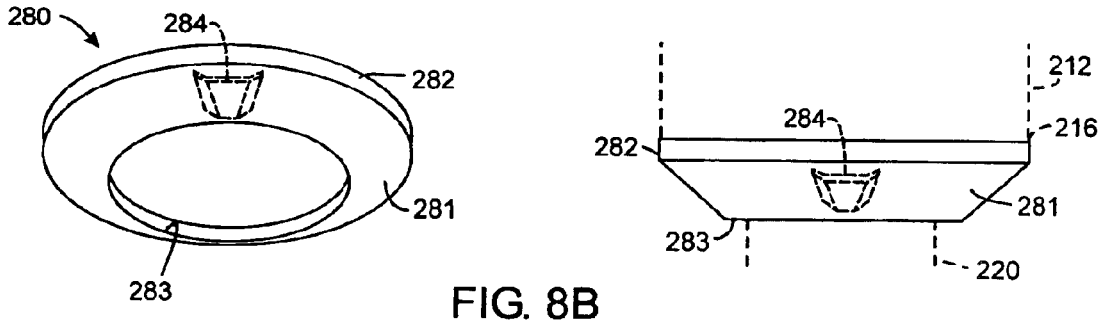

In FIG. 8B, another embodiment of a conductive member 280 is illustrated in a perspective view and a side view. The conductive member 280 resembles a Belleville washer known in the art. To improve the continuity of the conductive member 280 with a lower end frame (not shown), the conductive member 280 acts as a compact spring. The conductive member 280 includes a dish or cone shaped body 281 having an outer diameter on one end 282 and having an inner diameter on another end 283. The conductive member 280 may be formed from a flat washer made from spring grade steel that is pressed into the dish or cone shaped body 281 and then hardened and tempered. Preferably, the conductive member 280 is molded onto the quick connect plug with the end 282 having the outer diameter positioned at the shoulder 216. Not only does the spring action of the conductive member 280 helps to maintain continuity between the conductive member 280 and the lower end frame, but the conductive member 280 helps to maintain the quick connect plug on the lower end frame. The spring action of the conductive member 280 helps to further engage retainers on the second portion 220, such as the retainers 240 discussed above in FIG. 7B, against the lower end frame.

Figure 8C:
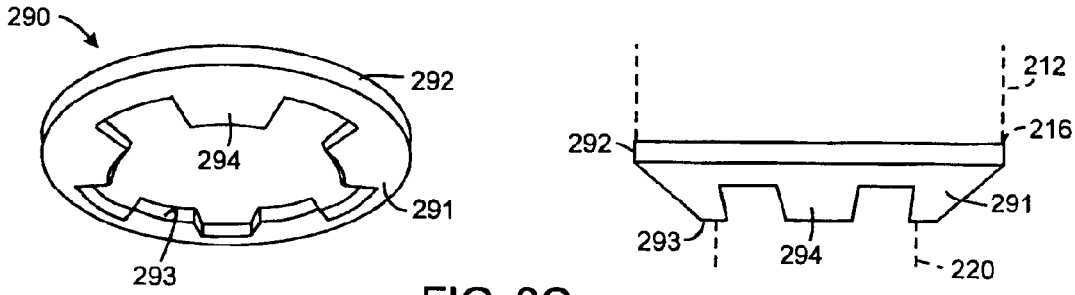

In FIG. 8C, another embodiment of a conductive member 290 is illustrated in a perspective view and a side view. The conductive member 290 includes a body 291 having an outer diameter 292 and an inner diameter 293. The inner diameter 293 defines a plurality of lifted tabs 294. Preferably, the conductive member 290 is molded onto the quick connect plug with the outer diameter 292 positioned at the shoulder 216. The plurality of lifted tabs 294 provide a spring action that helps to maintain the quick connect plug on the lower end frame and to maintain continuity between the conductive member 290 and the lower end frame. In addition, when the quick connect plug is rotated within an aperture of the lower end frame as described above in FIGS. 7A–B, the lifted tabs 294 can lock into slots defined in the aperture.

Figure 8D:
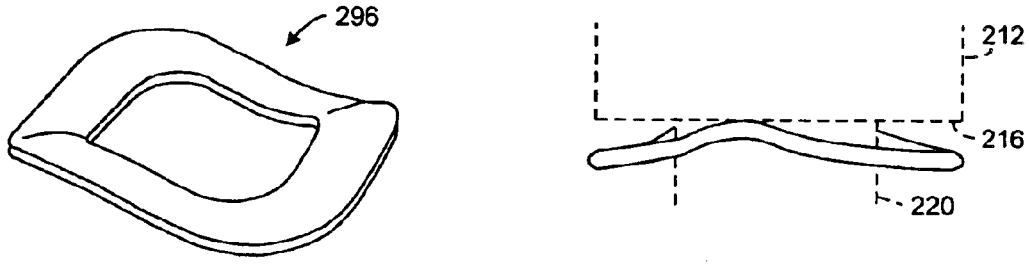

In FIG. 8D, yet another embodiment of a conductive member 296 is illustrated in a perspective view and a side view. The conducting member 296 resembles a wave washer known in the art. Like the former embodiments of FIGS. 8B–C, the conductive member 296 acts as a spring to maintain the quick connect plug on the lower end frame and to maintain continuity between the conductive member 296 and the lower end frame. It is understood that this and other embodiments of conductive members disclosed herein can include features in combination with one another to form additional embodiments of conductive members not explicitly illustrated. For example, this and other embodiments of conductive members can include detents, such as detent 284 shown on the conductive member 280 in FIG. 8B, for locking the quick connect plug in place as discussed above.

In FIG. 8E, yet another embodiment of a conductive member 400 is illustrated in a perspective view and a cutaway side view. Conducting member 400 contains a ring shaped lower portion 402 designed to contact lower end frame 50 at 403 (as described similarly with respect to FIG. 8A). Conducting member 400 also contains an upper portion 404 that has a smaller outside diameter than lower portion 402 such that upper portion 404 can pass through the aperture in the lower end frame. Upper portion 404 contains a cap 406 with features (408, 410) designed to improve the constant metal-to-metal contact desired for proper grounding of the appliance. For example, one or more contacting arms 408 may be used to provide a constant metal-to-metal ground connection with the edge of the aperture (at 409). One or more contacting arms 410 may be used for a dual purpose: (1) to provide a constant metal-to-metal ground with the inside surface 412 of the lower edge frame; and (2) to replace retainers 240 (for example, in FIG. 7A) in securing the plug to the lower end frame. As can best be seen from the side view in FIG. 8E, conductive member 400 as described above thus contacts the lower end frame at three locations—the outside surface 403 of the lower end frame, the inside surface 412 of the lower end frame, and at the aperture edge 409.

Figure 9:
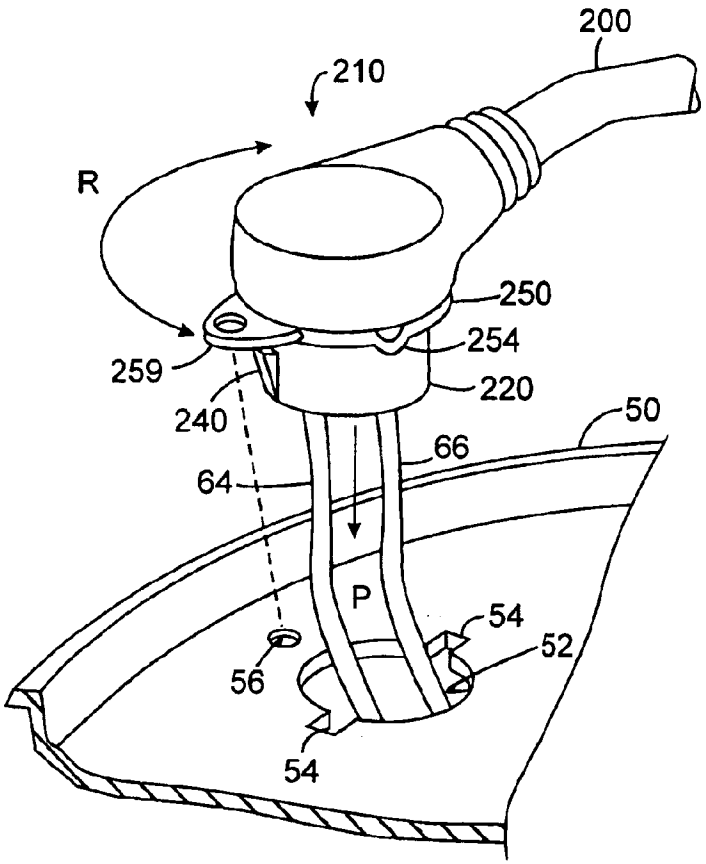
FIG. 9 illustrates a perspective view of another embodiment of a quick connect plug on a power cord according to the present invention.

Referring to FIG. 9, another embodiment of a quick connect plug 210 according to the present invention is illustrated on a power cord 200. The plug 210 is substantially the same as that described above with reference to FIGS. 7A–B. The plug 210 is shown with wires 64 and 66 installed in the second portion 220 and ready to attach to the lower end frame 50 of the disposer.

Certain agencies, such as Underwriters Laboratories (UL), the Consumer Safety Agency (CSA), and the British Electrotechnical Approvals Board (BEAB), may require that a ground connection of an appliance be made specifically with a fastener or screw. Therefore, the conductive member 250 in the present embodiment includes an extension 259 having a fastener aperture defined therethrough. When the second portion 220 is inserted and turned in the hole 52 as discussed previously, the fastener aperture of the extension 259 aligns with another fastener aperture 56 defined in the lower end frame 50. A fastener or screw (not shown) is then used to affix the conductive member 250 to the end frame 50 to meet such a requirement.

Figure 10:
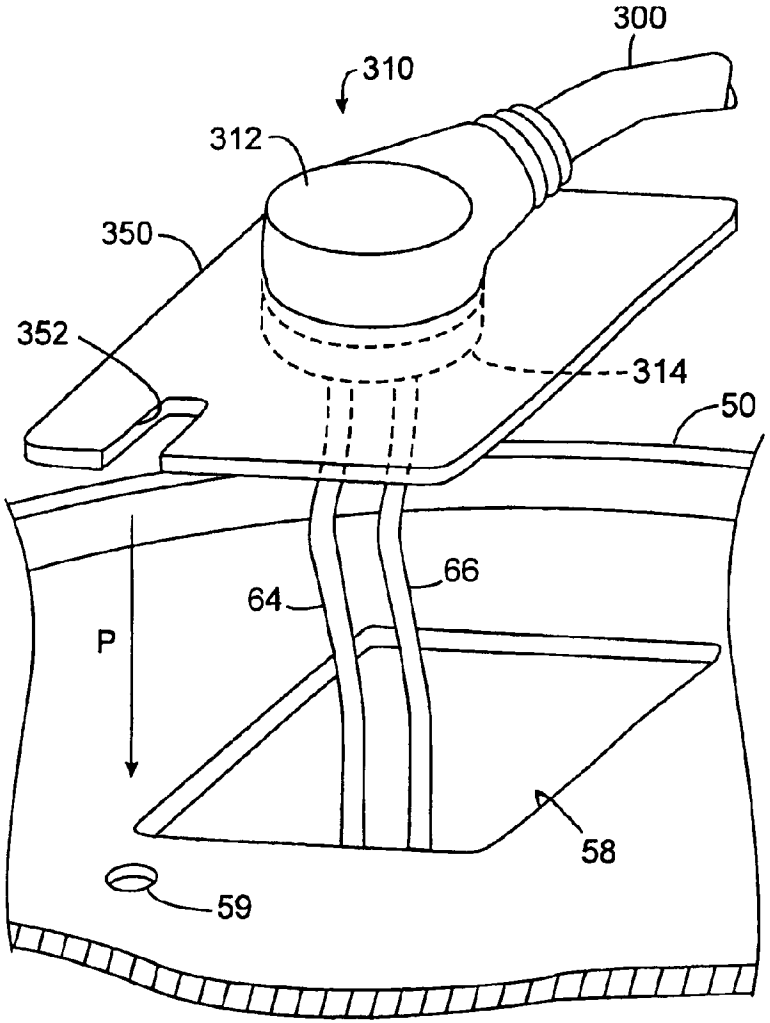
FIG. 10 illustrates a perspective view of yet another embodiment of a quick connect plug incorporating a cover plate as a conductive member according to the present invention.

Referring to FIG. 10, yet another embodiment of a quick connect plug 310 according to the present invention is illustrated on a cord 300. The plug 310 has one end 312 connected to the power cord 300. Another end 314 of the plug 310 receives leads 64 and 66 from the disposer. As in previous embodiments, the plug 310 houses connective members (not shown) electrically connected to the hot and neutral wires (not shown) of the cord 300. In the present embodiment, however, the plug 310 is molded with a conductive member or plate 350. The plate 350 in the present embodiment is substantially larger than in previous embodiments and extends well beyond the sides of the plug 310 between the ends 312 and 314. The plate 350 is electrically connected to the ground wire (not shown) of the cord 300. The plate 350 is then positioned in direction P over a wire access opening 58 defined in the lower end frame 50. The plate 350 contacts and grounds the lower end frame 50, as explained earlier. The plate 350 includes one or more fastener openings 352 for securing the plate 350 to the frame 50 with a fastener or screw (not shown). Like the previous embodiment in FIG. 9, the present embodiment of the plug 310 with plate 350 may meet agency requirements for establishing the ground connection of an appliance with a fastener or screw.

Figure 11A:
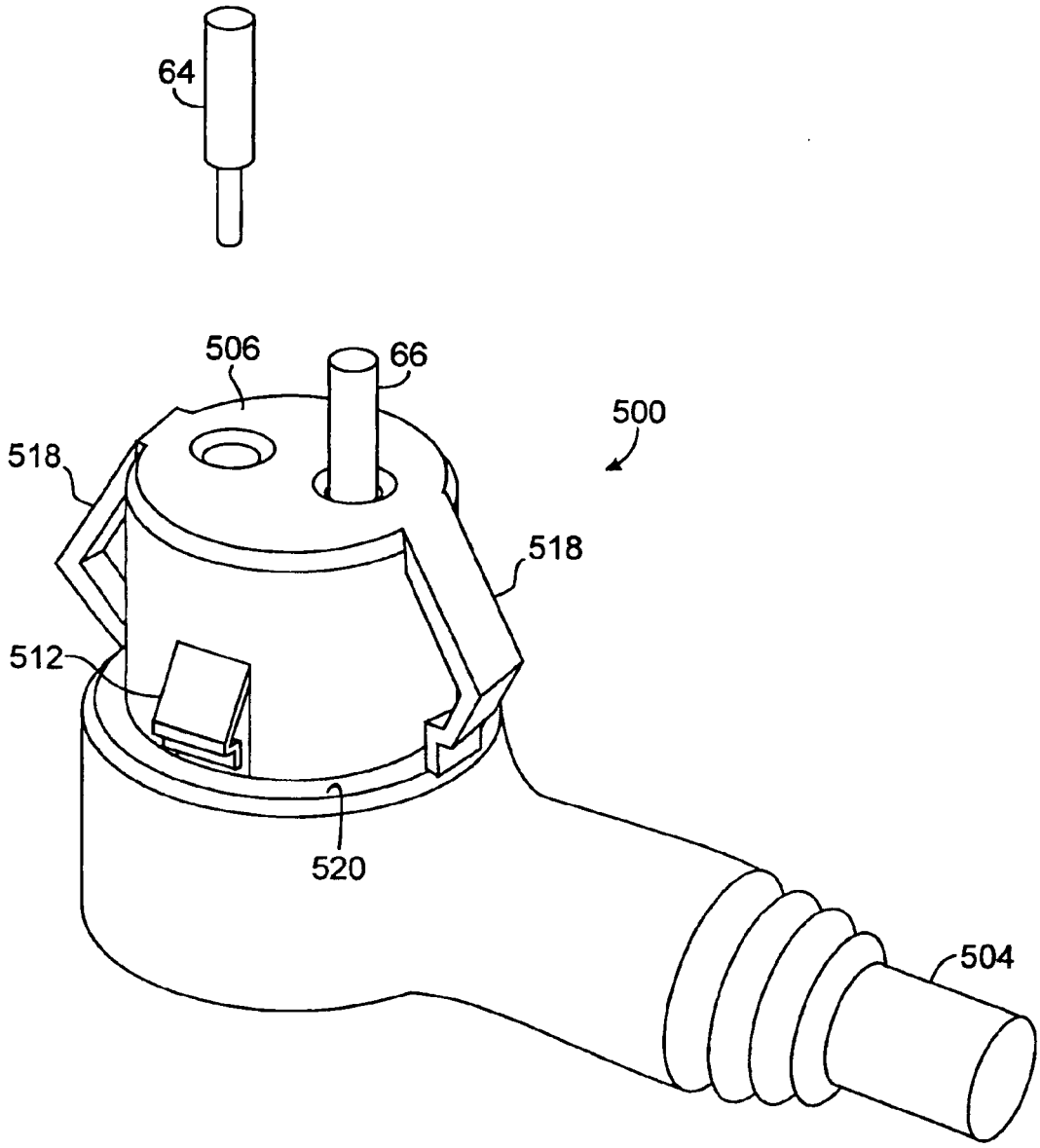
FIGS. 11A–11C illustrate a perspective view of yet another embodiment of a quick connect plug incorporating latching arms as the conductive member according to the present invention.
Figure 11B:
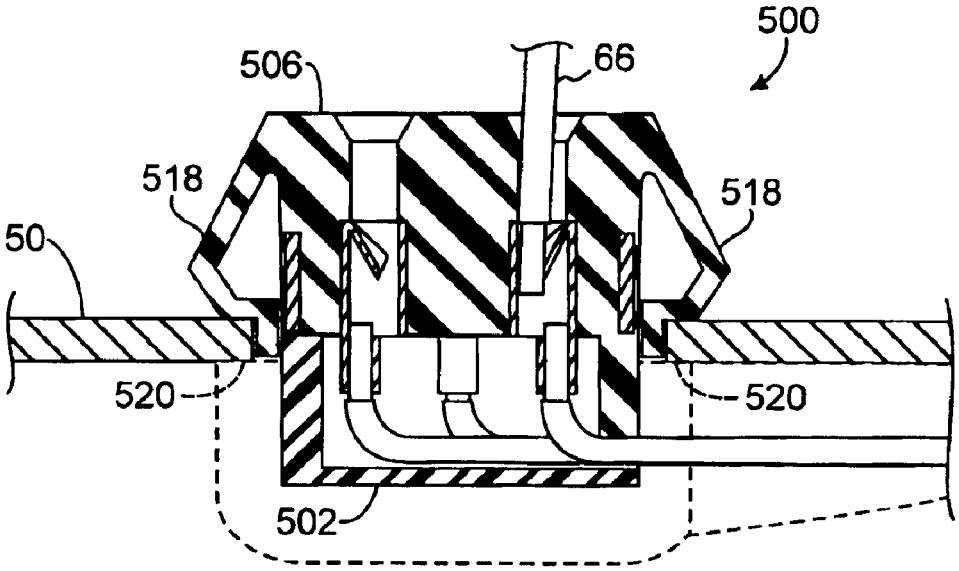
Figure 11C:
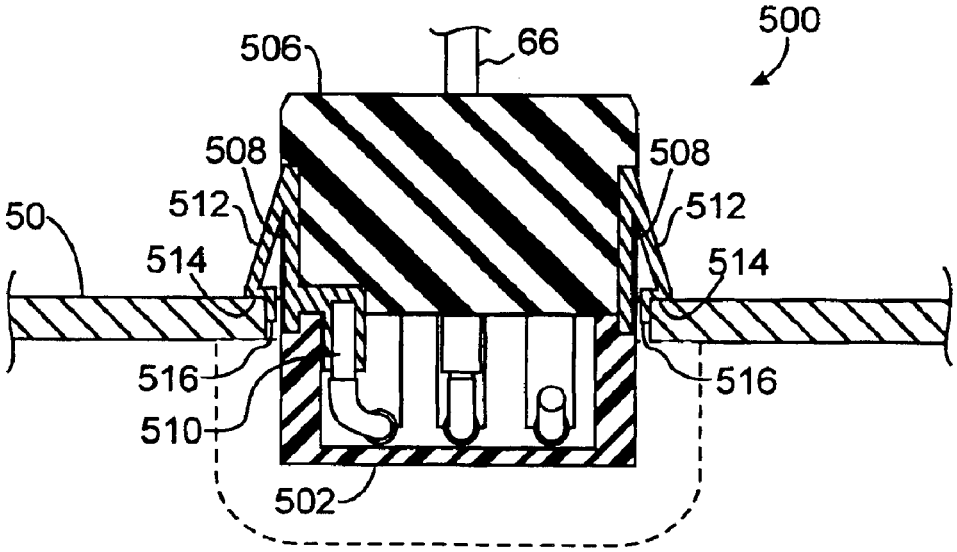

Referring to FIGS. 11A–C, yet another embodiment of a quick connect plug 500 according to the present invention is illustrated. FIGS. 11B and 11C illustrate the plug of FIG. 11A from two different side views (rotated 90 degrees). The plug 500 has one end 502 connected to the power cord 504. Another end 506 of the plug 500 receives leads 64 and 66 from the disposer. As in previous embodiments, the plug 500 houses connective members (not shown) electrically connected to the hot and neutral wires (not shown) of the cord 504. In the present embodiment, however, the plug 500 is molded with a conductive member 508. The conductive member 508 is electrically connected to the ground wire as generally shown at 510 and in a manner similar to that described with respect to FIG. 6B. In this embodiment, conductive member 508 contacts the lower end frame 50 and therefore grounds the appliance through one or more conductive spring latch members 512. As best shown in FIG. 11C, spring latch members 512 contact the lower end frame both on the inside surface 514 of the lower end frame and at the edge 516 of the aperture. Additionally, one or more non-conductive spring latch members 518 may be used to secure the plug in the aperture in tension against the shoulder 520 formed by the first portion of the plug.

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

What is claimed is:

1. On a cord for supplying power to an appliance, the cord having a first wire, a second wire, and a ground wire, the appliance having leads and having a metal portion with an aperture defined therein, a plug comprising:

a first portion capable of receiving the leads from the appliance;

a second portion connected to the cord and capable of engaging an outside surface of the metal portion adjacent the aperture;

connective members housed within the plug, being electrically connected to the first and second wires, and capable of electrically connecting to the leads received in the first portion; and a conductive member electrically connected to the ground wire and capable of contacting the metal portion.

2. The plug of claim 1, wherein the appliance is a food waste disposer.

3. The plug of claim 1, wherein the connective members comprise push-in terminals capturing conductive ends of the leads.

4. The plug of claim 3, wherein the push-in terminals comprise a mechanism for releasing the conductive ends of the leads.

5. The plug of claim 1, wherein the plug defines a shoulder between the first and second portions.

6. The plug of claim 5, wherein the conductive member is a ring located at the shoulder.

7. The plug of claim 1, wherein the first portion is capable of engaging an inside surface of the metal portion adjacent the aperture.

8. The plug of claim 7, wherein the first portion contains at least one retainer capable of securing the plug within the aperture.

9. The plug of claim 8, wherein the at least one retainer comprises tabs located about the periphery of the first portion, the tabs being capable of insertion through slots defined in the aperture.

10. The plug of claim 9, wherein the tabs are engaged to the inside surface by rotating the plug.

11. The plug of claim 10, wherein the conductive member comprises detents that dispose within the slots when the plug is rotated.

12. The plug of claim 1, wherein the conductive member has a hole or slot for fastening the conductive member to the metal portion.

13. The plug of claim 1, wherein the conductive member comprises a body capable of biased engagement with the metal portion.

14. The plug of claim 13, wherein the conductive member is capable of simultaneously engaging the inside surface and the outside surface of the metal portion.

15. The plug of claim 13, wherein the conductive member is capable of simultaneously engaging the inside surface of the metal portion, the outside surface of the metal portion, and the edge of the aperture.

16. The plug of claim 13, wherein the conductive member is capable of simultaneously engaging the inside surface of the metal portion and the edge of the aperture.

17. On a cord for supplying power to an appliance, the cord having a first wire, a second wire, and a ground wire, the appliance having leads with conductive ends and having a metal portion with an aperture defined therein, a plug comprising:

a receiving portion capable of receiving the conductive ends of the leads;

connective members housed within the plug, the connective members being electrically connected to the first and second wires and capable of capturing the conductive ends; and a conductive member being electrically connected to the ground wire and capable of engaging the metal portion.

18. The plug of claim 17, wherein the appliance is a food waste disposer.

19. The plug of claim 17, wherein the connective members comprise a mechanism for releasing the conductive ends of the leads.

20. The plug of claim 17, wherein the conductive member is a ring positioned on the exterior surface of the plug.

21. The plug of claim 17, further comprising at least one retainer capable of securing the plug within the aperture.

22. The plug of claim 17, wherein the conductive member comprises a body capable of biased engagement with the metal portion.

23. The plug of claim 22, wherein the conductive member is capable of simultaneously engaging the inside surface and the outside surface of the metal portion.

24. The plug of claim 22, wherein the conductive member is capable of simultaneously engaging the inside surface of the metal portion, the outside surface of the metal portion, and the edge of the aperture.

25. The plug of claim 22, wherein the conductive member is capable of simultaneously engaging the inside surface of the metal portion and the edge of the aperture.

26. The plug of claim 17, wherein the conductive member is a ring terminal attachable to the metal portion using a fastener.

27. On a cord for supplying power to an appliance, the cord having a first wire, a second wire, and a ground wire, the appliance having leads with conductive ends and having a metal portion with an aperture defined therein, a plug comprising:

connective members housed within the plug, the connective members being electrically connected to the first and second wires and capable of capturing the conductive ends of the leads;

a first portion of the plug capable of insertion through the aperture and comprising openings to receive the leads from the appliance;

a second portion of the plug defining a shoulder with the first portion;

at least one retainer for securing the plug within the aperture; and a conductive member electrically connected to the ground wire and capable of biased engagement with the metal portion.

28. The plug of claim 27, wherein the appliance is a food waste disposer.

29. The plug of claim 27, wherein the connective members comprise a mechanism for releasing the conductive ends of the leads.

30. The plug of claim 27, wherein the conductive member is a ring positioned on the exterior surface of the plug.

31. The plug of claim 27, wherein the at least one retainer engages an inside surface of the metal portion adjacent the aperture.

32. The plug of claim 27, wherein the conductive member is capable of simultaneously engaging the inside surface and the outside surface of the metal portion.

33. The plug of claim 27, wherein the conductive member is capable of simultaneously engaging the inside surface of the metal portion, the outside surface of the metal portion, and the edge of the aperture.

34. The plug of claim 27, wherein the conductive member is capable of simultaneously engaging the inside surface of the metal portion and the edge of the aperture.

35. The plug of claim 27, wherein the conductive member is a ring terminal attachable to the metal portion using a fastener.

36. A method for assembling a power cord on an appliance, the power cord having a first wire, a second wire, and a ground wire, the appliance having leads and having a metal portion with an aperture defined therein, the method comprising:

a) housing wire ends of the first and second wires in a plug;

b) electrically connecting the ground wire to an outside portion of the plug;

c) electrically connecting the leads to the wire ends; and d) mechanically engaging the plug to the metal portion adjacent the aperture.

37. The method of claim 36, wherein the cord has a third wire whose end is housed within the plug.

38. The method of claim 36, wherein step (d) grounds the appliance.

39. The method of claim 36, wherein step (c) comprises receiving ends of the leads inside the plug and connecting the lead ends with connective members attached to the wire ends.

40. The method of claim 36, wherein step (d) comprises engaging the plug with the inside surface and the outside surface of the metal portion adjacent the aperture.

41. The method of claim 36, wherein step (d) further comprises inserting the plug into the aperture and rotating the plug within the aperture.

42. The method of claim 36, wherein step (d) comprises engaging tabs disposed on the plug with the inside surface of the metal portion of the metal portion adjacent the aperture, and engaging a shoulder on the plug against an outside surface of the metal portion.

43. The method of claim 36, wherein the ground wire is electrically connected to a conductive member located on the outside surface of the plug.

44. The method of claim 43, wherein the conductive member simultaneously engages the inside surface and the outside surface of the metal portion.

45. The method of claim 43, wherein the conductive member simultaneously engages the inside surface of the metal portion, the outside surface of the metal portion, and the edge of the aperture.

46. The method of claim 43, wherein the conductive member simultaneously engages the inside surface of the metal portion and the edge of the aperture.

47. A method for grounding an appliance, the power cord having a first wire coupled to a first terminal within a plug, a second wire coupled to a second terminal within the plug, and a ground wire coupled to a conductive member located on the outside surface of the plug, the appliance having a first lead and a second lead and a metal portion with an aperture defined therein, the method comprising:

a) respectively coupling the first and second leads to the first and second terminals; and b) inserting an end of the plug into the aperture, whereby such insertion brings the conductive member into biased engagement with the metal portion.

48. A method for assembling a power cord on an appliance, the power cord having a first wire coupled to a first terminal within a plug, a second wire coupled to a second terminal within the plug, and a ground wire, the appliance having a first lead and a second lead and a metal portion with an aperture defined therein, the method comprising:

a) respectively coupling the first and second leads to the first and second terminals;

b) fastening the ground wire to the metal portion;

c) inserting an end of the plug into the aperture; and d) rotating the end of the plug so as to affix the plug within the aperture.

* * * * *